US010386141B2

(12) United States Patent
Harris et al.

(10) Patent No.: US 10,386,141 B2
(45) Date of Patent: Aug. 20, 2019

(54) AUTOMATIC MAGAZINE EJECTION FOLLOWER INSERT SYSTEM

(71) Applicant: Evolusion Concepts, Inc., San Diego, CA (US)

(72) Inventors: Courtney Harris, San Diego, CA (US); Glenn Banaag, Los Angeles, CA (US)

(73) Assignee: Evolusion Concepts, Inc., San Diego, CA (US)

( * ) Notice: Subject to any disclaimer, the term of this patent is extended or adjusted under 35 U.S.C. 154(b) by 0 days.

(21) Appl. No.: 15/871,738

(22) Filed: Jan. 15, 2018

(65) Prior Publication Data

US 2019/0049204 A1 Feb. 14, 2019

Related U.S. Application Data

(63) Continuation-in-part of application No. 15/730,822, filed on Oct. 12, 2017, and a continuation-in-part of application No. 15/676,029, filed on Aug. 14, 2017, now abandoned.

(51) Int. Cl.

| | |
|---|---|
| ***F41A 9/70*** | (2006.01) |
| ***F41A 9/59*** | (2006.01) |
| ***F41A 3/66*** | (2006.01) |
| ***F41A 9/66*** | (2006.01) |

(52) U.S. Cl.

CPC ..... *F41A 9/70* (2013.01); *F41A 3/66* (2013.01); *F41A 9/59* (2013.01); *F41A 9/66* (2013.01)

(58) Field of Classification Search

CPC .... F41A 9/70; F41A 9/65; F41A 17/38; F41A 3/66

USPC ..... 42/49.01, 50

See application file for complete search history.

(56) References Cited

U.S. PATENT DOCUMENTS

| | | | | |
|---|---|---|---|---|
| D745,945 | S * | 12/2015 | Kielsmeier | D22/108 |
| 9,222,739 | B1 * | 12/2015 | Bennett | B23P 15/22 |
| 9,383,152 | B2 * | 7/2016 | Nakayama | F41A 9/70 |
| 2013/0269232 | A1 * | 10/2013 | Harris | F41A 9/64 42/49.01 |
| 2015/0292826 | A1 * | 10/2015 | Kielsmeier | F41A 9/70 42/50 |
| 2015/0345882 | A1 * | 12/2015 | Nakayama | F41A 9/70 42/50 |
| 2016/0348992 | A1 * | 12/2016 | Tisone | F41A 9/59 |

* cited by examiner

*Primary Examiner* — Michael D David

(74) *Attorney, Agent, or Firm* — Kevin Keener; Keener and Associates P.C.

(57) ABSTRACT

A follower insert system for a follower in a firearm magazine is disclosed. The follower insert system comprises an insert block having a front side, a rear side, a top side, and two lateral sides facing in opposite directions, wherein at least one of said two lateral sides has a recess; a spring disposed in said recess of said insert block; and a lateral pin disposed adjacent to said spring. The follower insert system may further comprise a cover disposed on a lateral side of said insert block, wherein said cover has an aperture disposed in alignment with said recess of said insert block, wherein said lateral pin is disposed through said aperture of said cover. When the follower reaches the top portion of a magazine, the lateral pin engages the magazine release and the magazine is automatically ejected.

15 Claims, 4 Drawing Sheets

AUTOMATIC MAGAZINE EJECTION FOLLOWER INSERT SYSTEM

PRIORITY

This application is a continuation-in-part of U.S. patent application Ser. No. 15/676,029, filed on Aug. 14, 2017, the disclosure of which is hereby incorporated by reference, and a continuation-in-part of U.S. patent application Ser. No. 15/730,822, filed on Oct. 12, 2017, the disclosure of which is hereby incorporated by reference.

FIELD OF THE INVENTION

This invention pertains generally to ammunition magazines for firearms and more specifically to an automatic magazine ejection follower insert.

BACKGROUND OF INVENTION

Followers are known in the art. A follower is a component situated within a magazine between a lower spring and the ammunition rounds in the magazine. As the rounds are fired from the firearm, the spring pushes the follower up along the body of the magazine, pushing the rounds into the firing chamber for continued firing.

A standard OEM semi-automatic rifle contains a magazine catch assembly. A standard magazine catch assembly is comprised of a magazine catch, a spring, and magazine release button. The magazine catch consists of two ends which occur at a substantially right angle. One end is a threaded screw. The other end is a substantially flat member. When installed in a semi-automatic rifle, the spring is placed over the threaded screw end of the magazine catch. The screw is then inserted through the lower receiver and threaded through the magazine catch button on the opposite side of the lower receiver. The opposite end of the magazine catch rests within a recess in the magazine well receiver. When a magazine is placed in the magazine well the magazine catch slides into a recess in the magazine. The catch holds the magazine in place while the firearm is in use. To release the magazine, a user pushes the magazine release button. When the magazine release button is depressed the magazine catch is lifted from the recess in the magazine and the magazine freely slides out of the magazine well.

When a magazine is empty the user does not know until the user has fired all of the rounds from magazine, including those from the magazine which are in the chamber. So currently when a magazine is empty it is still attached to the lower receiver of the firearm. The user does not become aware that the magazine is empty until the user pulls the trigger and the firearm does not fire. At this point in time then the user pushes the magazine release button. The magazine release button is attached to the magazine catch bar. The magazine catch bar resides in a catch recess in the magazine which prevents the magazine from being removed. Once the magazine catch bar is disengaged then the user removes the empty magazine and replaces it with a full magazine to continue firing.

This process is inefficient. A user is unable to fire the firearm while removing the magazine and attaching a new magazine. What is needed is a device and method whereby the magazine is automatically ejected from the firearm after the last round has left the magazine but is yet to be fired. This would increase the efficiency of use because the user does not have to remove the empty magazine but instead can simply insert the new magazine and continue firing.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a follower insert system comprising an insert block having a front side, a rear side, a top side, and two lateral sides facing in opposite directions, wherein at least one of said two lateral sides has a recess; a spring disposed in said recess of said insert block; and a lateral pin disposed adjacent to said spring.

The follower insert system may further comprise a cover disposed on a lateral side of said insert block, wherein said cover has an aperture disposed in alignment with said recess of said insert block, wherein said lateral pin is disposed through said aperture of said cover.

The follower insert system may further comprise a follower disposed on said top side of said insert block. In another embodiment of the invention, the top side of said insert block has a recess for receiving a portion of a follower. In another embodiment of the invention a portion of said front side of said insert block is curved. In another embodiment of the invention, a top portion of said insert block has a width less than a width of a bottom portion of said insert block. In another embodiment of the invention, a top portion of said insert block ha a length less than a length of a bottom portion of said insert block.

The invention is also directed toward a method of converting a magazine into an automatically ejected magazine comprising removing a factory installed follower from a magazine; placing a follower insert system against a bottom side of said follower; wherein said follower insert system comprises an insert block having a front side, a rear side, a top side, and two lateral sides facing in opposite directions wherein at least one of said two lateral sides has a recess; a spring disposed in said recess of said insert block; and a lateral pin disposed adjacent to said spring; and inserting said follower with said follower insert system into said magazine.

The method may further comprise replacing said factory installed follower with a replacement follower. The method may further comprise ensuring a bottom side of said insert block is disposed adjacent to a spring disposed in said magazine. The method may further comprise inserting said magazine into a magazine well of a lower receiver of a firearm.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

The invention is an improved follower for a magazine. The follower can be made in any configuration. Similar followers already known in the art include U.S. Pat. No. 9,470,464 (Kielsmeier et al.), U.S. D745,945 (Kielsmeier et al.), U.S. Pat. No. 9,429,378 (Bennett et al.), U.S. D667,915 (Nakayam et al.), U.S. Pat. No. 8,069,601 (Fitzpatrick et al.), U.S. Pat. No. 8,061,071 (Fitzpatrick et al.), and U.S. 2015/0345882 (Nakayama et al.), all of which are hereby incorporated by reference. The current invention can be utilized on any follower type, including the followers disclosed by these references.

Figure 1:
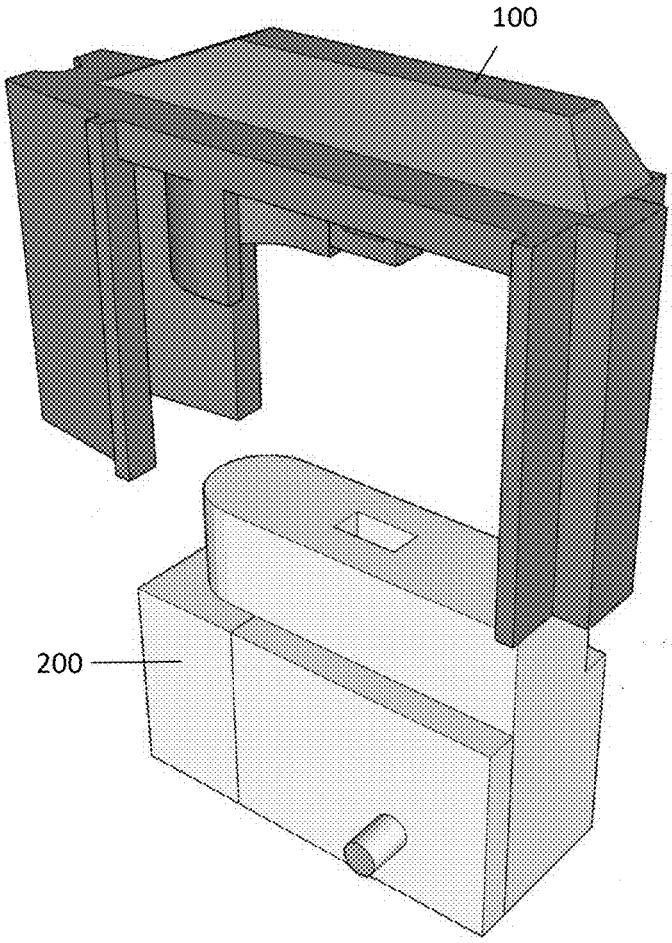
FIG. 1 is a top perspective view of the follower insert and follower.
Figure 2:
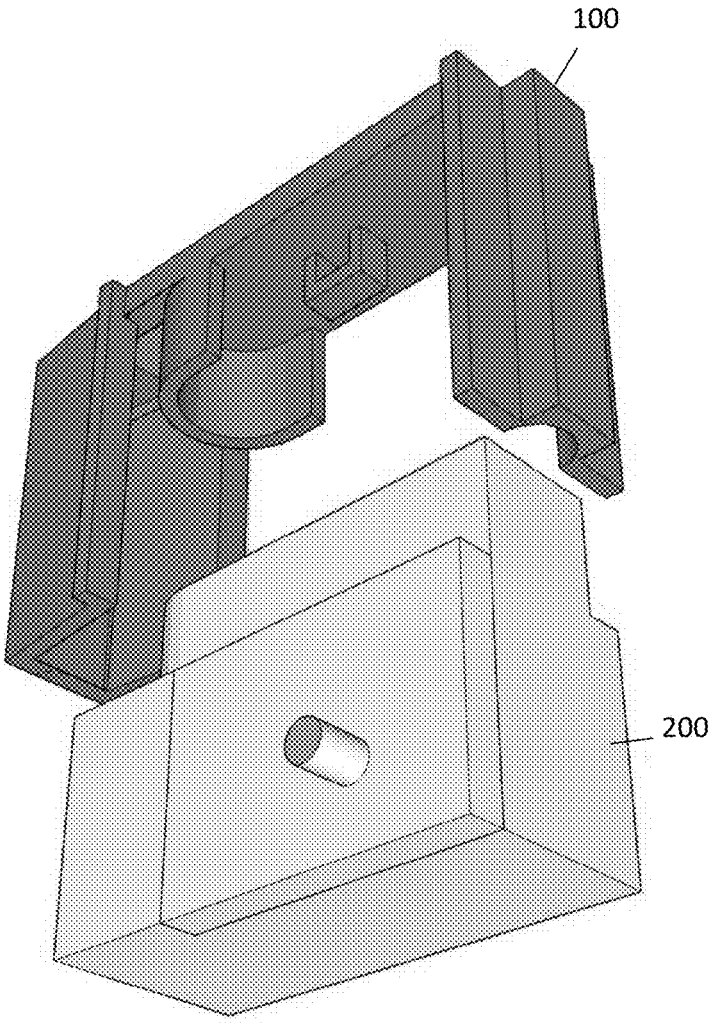
FIG. 2 is a bottom perspective view thereof.
Figure 3:
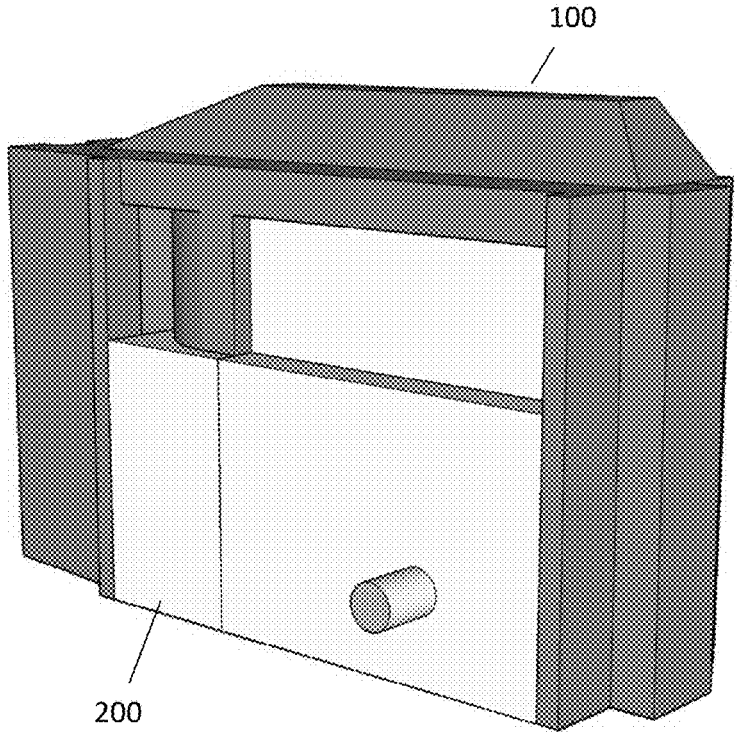
FIG. 3 is side angled view thereof.
Figure 4:
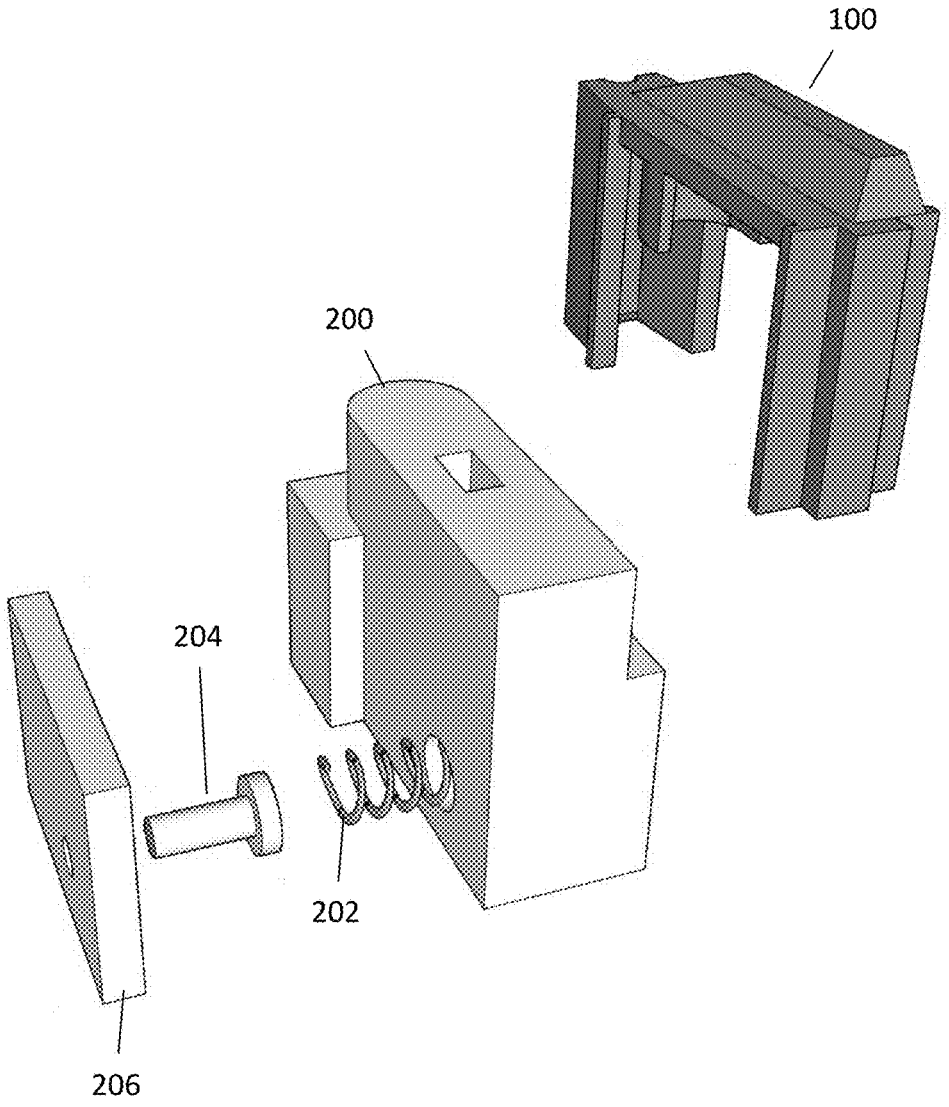
FIG. 4 is an exploded view thereof.

Referring to FIGS. 1-4, the preferred embodiment of the follower insert system is illustrated. The follower insert system may be used in conjunction with a follower 100. In some embodiments the follower 100 is a factory installed OEM follower. In other embodiments the follower 100 is a replacement follower. In some embodiments the follower insert system has a follower 100 to be utilized or does not have a follower 100.

The main component of the follower insert system is the insert block 200. The insert block 200 may be any size and shape. The insert block 200 is configured to fit into an underside of a follower 100. The insert block 200 has a front side facing the direction of fire of the firearm, a rear side facing the rear of the firearm, a top side, a bottom side, and two lateral sides. The insert block 200 may have one or more recesses in the top side into which portions of the follower 100 may be disposed. Alternatively, the insert block 200 may have one or more protrusions extending from the top side to engage portions of the follower 100. The insert block 200 may be further shaped to complement the follower 100 to ensure a complete fit to the follower 100 such that the insert block 200 is immovable. In the preferred embodiment the top portion of the insert block 200 has a narrower width than the bottom portion. In addition, the length of the top portion of the insert block 200 is shorter than the length of the bottom portion of the insert block 200. In other embodiments the width and length of the insert block 200 is consistent between the top portion and the bottom portion. In the preferred embodiment the front portion of the top portion of the insert block 200 is curved.

The insert block 200 has a lateral recess disposed one side of the insert block 200. The recess may be any size and shape. The recess houses a spring 202. The spring 202 is utilized to push a pin 204 laterally from the insert block 200. The pin 204 may be pushed toward the insert block 200, compressing the spring 202. The pin 204 may be any size and shape. In the preferred embodiment the pin 204 has a flange. The insert block system may also utilize a cover 206. The cover 206 is disposed on a lateral side of the insert block 200. The cover 206 has an aperture which is aligned with the recess of the insert block. The pin 204 is disposed through the cover 206. The flange of the pin 204 prevents the pin 204 from accidentally falling away from the insert block 200 and being lost.

To utilize the follower insert system, a user removes a follower 100 from a magazine of a firearm. The user then inserts the block insert 200 into the bottom portion of the follower 100. In some embodiments the user removes the factory installed follower 100 and utilizes a replacement follower 100. The user then ensures that the insert block 200 is disposed in a correct orientation and configuration with the follower 100. The user then places the bottom side of the insert block 200 inward into the magazine. When the in use, when there are rounds within the magazine, the spring 202 pushes the pin 204 toward the side wall of the magazine. When the last round is fired, the pin 202 is aligned with an aperture in the wall of the magazine. The pin 202 passes into the aperture in the wall of the magazine and pushes against the magazine catch. The spring 202 then pushes the pin 204 against the magazine catch, forcing the magazine catch outward from the aperture in the magazine wall. Once the magazine catch is disengaged from the magazine, the magazine naturally slides out of the magazine well of the lower receiver. The user can then insert a new magazine into the magazine well without needing to push the magazine release button on the lower receiver.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A magazine follower insert system comprising a) an insert block having a front side, a rear side, a top side, and two lateral sides facing in opposite directions i) wherein at least one of said two lateral sides has a recess;

b) a spring disposed in said recess of said insert block;

c) a lateral pin disposed adjacent to said spring; and d) wherein said top side of said insert block has a top recess, wherein a bottom side of a follower has an extended member protruding from said bottom side of said follower, and wherein said extended member is disposed within said top recess.

2. The magazine follower insert system as in claim 1 further comprising a cover disposed on a lateral side of said insert block, wherein said cover has an aperture disposed in alignment with said recess of said insert block, wherein said lateral pin is disposed through said aperture of said cover.

3. The magazine follower insert system as in claim 1 wherein a portion of said front side of said insert block is curved.

4. The magazine follower insert system as in claim 1 wherein a top portion of said insert block has a width less than a width of a bottom portion of said insert block.

5. The magazine follower insert system as in claim 1 wherein a top portion of said insert block has a length less than a length of a bottom portion of said insert block.

6. The magazine follower insert system as in claim 2 wherein a top portion of said insert block has a width less than a width of a bottom portion of said insert block.

7. The magazine follower insert system as in claim 6 wherein a top portion of said insert block has a length less than a length of a bottom portion of said insert block.

8. The magazine follower insert system as in claim 7 wherein a portion of said front side of said insert block is curved.

9. The magazine follower insert system as in claim 8 wherein said follower is disposed on said top side of said insert block.

10. A method of converting a magazine into an automatically ejected magazine comprising a) removing a factory installed follower from a magazine;

b) placing a follower insert system against a bottom side of said factory installed follower;

i) wherein said follower insert system comprises (1) an insert block having a front side, a rear side, a top side, and two lateral sides facing in opposite directions (2) wherein at least one of said two lateral sides has a recess;

(3) a spring disposed in said recess of said insert block;

(4) a lateral pin disposed adjacent to said spring; and (5) wherein said top side of said insert block has a top recess, wherein said bottom side of said factory installed follower has an extended member protruding from said bottom side of said factory installed follower, and wherein said extended member is disposed within said top recess; and c) inserting said factory installed follower with said follower insert system into said magazine.

11. The method as in claim 10 further comprising replacing said factory installed follower with a replacement follower.

12. The method as in claim 10 further comprising ensuring a bottom side of said insert block is disposed adjacent to a magazine spring disposed in said magazine.

13. The method as in claim 10 further comprising inserting said magazine into a magazine well of a lower receiver of a firearm.

14. The method as in claim 12 further comprising inserting said magazine into a magazine well of a lower receiver of a firearm.

15. The method as in claim 14 further comprising replacing said factory installed follower with a replacement follower.

* * * * *